US008193474B2

(12) United States Patent
Harris

(10) Patent No.: US 8,193,474 B2
(45) Date of Patent: Jun. 5, 2012

(54) SMART SENSING OVEN

(75) Inventor: Scott C. Harris, Rancho Santa Fe, CA (US)

(73) Assignee: Harris Technology, LLC, Rancho Santa Fe, CA (US)

( * ) Notice: Subject to any disclaimer, the term of this patent is extended or adjusted under 35 U.S.C. 154(b) by 891 days.

(21) Appl. No.: 12/174,791

(22) Filed: Jul. 17, 2008

(65) Prior Publication Data

US 2010/0015313 A1 Jan. 21, 2010

(51) Int. Cl.
*H05B 1/02* (2006.01)

(52) U.S. Cl. ..... 219/494; 219/506; 219/714; 99/325

(58) Field of Classification Search ..... 219/492, 219/497, 499, 501, 504–509, 483–486, 412–414, 219/711–714; 99/325–333
See application file for complete search history.

(56) References Cited

U.S. PATENT DOCUMENTS

| | | | | |
|---|---|---|---|---|
| 5,426,280 | A * | 6/1995 | Smith | 219/506 |
| 6,227,041 | B1 * | 5/2001 | Collins et al. | 73/76 |
| 6,559,882 | B1 * | 5/2003 | Kerchner | 348/61 |
| 7,473,869 | B2 * | 1/2009 | Chun | 219/506 |
| 7,820,948 | B1 * | 10/2010 | Renau | 219/494 |
| 2005/0016996 | A1 * | 1/2005 | Chun | 219/685 |

* cited by examiner

*Primary Examiner* — Mark Paschall
(74) *Attorney, Agent, or Firm* — Law Office of Scott C. Harris, Inc.

(57) ABSTRACT

Smart oven allows contactless detection of surface temperature of an item being heated. The temperature of the heated object can be maintained at the specified temperature for a specified time. The program for cooking can be read automatically from a package from the food, e.g, from a bar code on the package. When the preheating or cooking is finished, a text message can be sent to a user.

19 Claims, 1 Drawing Sheet

SMART SENSING OVEN

BACKGROUND

Ovens are typically controllable to cook food in a desired way.

A typical control of an oven may set the temperature, and set the amount of cooking time. This may be done based on cooking instructions. For example, cooking instructions might say "Cook in a 450° oven for 15 to 17 minutes or until cooked through". A user reads this off a box, sets the oven and time, and then monitors the cooking.

There is uncertainly in the cooking instructions because oven characteristics, e.g, temperatures, vary, and also different climates (humidity, altitude, etc,) may also vary the cooking time.

Toasters for toasting bread have similar issues.

SUMMARY

An embodiment describes an advanced oven that allows determination of food temperature. One embodiment allows, automatic detection of an amount of heating that has been applied to an object of heating such as a frozen pizza or a piece of toast.

Another embodiment discloses automatic setting of cooking instructions into a cooking device.

BRIEF DESCRIPTION OF THE DRAWINGS

These and other aspects will now be described in detail with reference to the accompanying drawings, wherein.

DETAILED DESCRIPTION

An embodiment monitors the food being cooked to determine its surface temperature. The oven may have a setting for surface temperature; and may terminate the cooking when the specified surface temperature has been reached.

For example, taking the example of toast, toast reaches specified levels of done-ness based on the surface temperature of the toast. Based on my tests, certain kinds of bread may be "lightly toasted" when the surface temperature reaches 450° F. The toast may start to burn when its surface temperature reaches around 510° F. Moreover, since the surface of the toast is not typically flat, different spots may have very different temperatures. Also, the sensing of temperature may itself be very different based on the different locations. Embodiments described herein may average temperatures taken in succession to determine an averaged surface temperature. Another embodiment may obtain the temperature of different locations on the object, and take a running average of those different locations to determine the temperature.

Compare this to the usual system which times the amount of cooking. This has no relation to what the inventor realized is truly important—how much heat has been applied to the material being cooked, as compared with how much heat has been produced.

These techniques may be used for any object of heating. An embodiment describes the special advantages when applied to toast. Toasters apply different amounts of energy depending on how hot the coils are when the toast is placed in the chamber. Moreover, different kinds of bread may absorb the heating in different ways. Therefore, golden brown toast might require one minute from one toaster; especially when that toaster is preheated. The same toasting effect might require three minutes from another toaster; especially when that toaster is cold.

Figure 1:
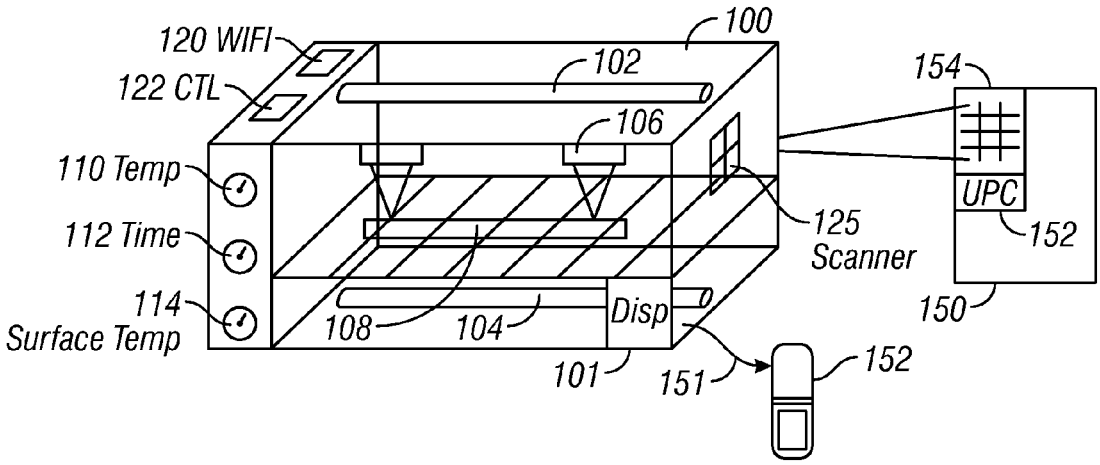
FIG. 1 illustrates an embodiment of an oven.
Figure 2:
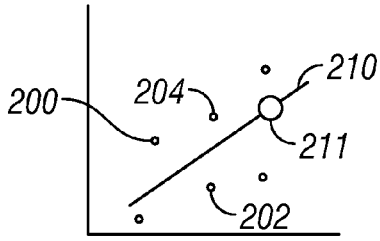
FIG. 2 shows a graph of temperatures.

One embodiment is shown in FIG. 1, where an oven 100 may include any or all of a number of different elements as discussed in this embodiment. The oven may include an upper heating coil 102 and a lower heating coil 104. It should be understood that these heating coils can be heating part of any type, e.g, resistive, inductive, microwave, gas, or any other style of heating. At least one contactless temperature sensor, in this embodiment a digital infrared temperature sensor, is placed in a location where it can view an object of heating 108. For example, this object of heating may be toast. The embodiment allows setting temperature with a temperature control 110. The temperature control may alternatively set other aspects of the intensity of heating, such as power from a microwave, number of BTU's delivered by the heating element per unit time, and others. The oven may also allow a conventional, time based control 112. In addition, however, this embodiment allows setting a surface temperature 114. When the surface temperature is set, the oven continues its heating effect until the desired surface temperature of the object of cooking has been reached. For example, if you set the surface temperature of 390°, the toasting may continue until the surface of the bread is detected to have reached 390°.

An averaging process may also be used, so that the different actual temperatures which are received or measured such as 200, 202, 204, are either normalized to a straight line graph 210, or a running average of multiple temperatures are taken and averaged. For example, if the past 5 temperatures are 370, 385, 370, 360, 385, the temperature for the current time is taken as (370+385+370+360+385)/5=374°. The digital infrared thermometers can also be aimed at different locations. In an embodiment, the location at which the temperature is taken may be varied between temperature acquisitions. This may be done in a deterministic way, e.g, along a circular or other shaped path. It may be done randomly, e.g, using a random number generator to determine a location where the temperature will be taken. Again, these values may be normalized or averaged or running averaged.

When the set surface temperature is established, the cooking effect may be terminated. In another embodiment, the surface temperature is maintained at the set temperature for some set time, e.g, 10 minutes. The heating device may be, for example turned off or reduced when the surface temperature is reached, and cycled on and off to maintain the surface temperature.

The oven may also include a number of advanced digital capabilities. There may be WiFi care capabilities 120 which connect with and provide instructions for a processor 122 that is controlled by the different temperatures. In addition, there may be a scanner 125, which may scan either barcodes or other information from the packaging of the food being cooked. In an embodiment, for example, different objects of cooking may include a code printed on the box which represents cooking instructions. For example, the pizza box 150 may include a universal product code 152, but also another barcode 154 that represents cooking instructions. The barcode 154 is preferably in a different format than universal product code, so that a UPC scanner will not mistakenly scan the cooking instructions 154, and vice versa so that the scanner 125 will not mistakenly scan the universal product code. The cooking instructions barcode may be one which is found invalid when scanning by a UPC scanner and vice versa.

The cooking instructions may include conventional cooking instructions such as temperature and amount of time for cooking. In an embodiment, cooking instructions may also include surface temperature information and/or desired oven BTU output per unit time. In operation, the code 154 is scanned by the scanner 125. Contents of the barcode automatically sets temperature/time/surface/BTU for cooking. The barcode may say, for example, 450° Heat/20 minutes/390° SurfaceT for 10 minutes/10000 BTU heat output. The oven may then operate according to these instructions.

As an alternative to the barcode 154, this information may be associated with the packaging of the object of cooking in other ways that can be automatically sensed by the cooking part. One embodiment may use an RF ID chip to read the cooking information from the packaging. In this case, a button on the oven may be used to signify a time when RFIDs in range should be read and executed.

Another embodiment may use a miniature memory device, e.g., a nonvolatile memory chip that contacts to a corresponding contact on the oven 100, or alternatively otherwise communicates therewith for example via WiFi connection.

Another embodiment can read a hologram from the device or some other optical code.

Another embodiment can use an OCR device which reads the written instructions.

According to another embodiment, the universal product code 102 is used to determine the cooking instructions. The oven scans the UPC and finds the product code information. This is used to look up information from a database that includes a table relating UPCs to cooking information that is related to that UPC. The universal product code is scanned, and the WiFi connection is used to contact an Internet database that stores cooking instructions for each of a plurality of different items to be cooked items, indexed by their universal barcode. The internet returns cooking instructions in a form that can be read and executed by the oven.

According to an embodiment, the oven also includes an audible device, which provides a "beep" when an appropriate cooking instruction has been received, e.g. when a barcode has been appropriately scanned, or some other item has been appropriately read or decoded.

The oven may also include a display 101 which allows different selections, and may display for example surface temperature, time, temperature, as well as the auto program initiation caused by scanning the barcode.

According to another embodiment, the codes may include multiple different sets of cooking instructions. Each cooking instruction may be for a different effect of cooking. For a pizza, Setting 1 may be normal cook; setting 2 can be crisp crust, setting 3 for extra crisp crust; setting 4 for pizza is thawed. The user is allowed to choose any of these programs, which are displayed on the display. In one embodiment, if the user does not select one of the programs, a default (here "normal cook") may be automatically selected.

One embodiment may also carry out preheating operation prior to or as part of the cooking instructions. For example, scanning the product code (or other automatically-provided instructions) may automatically cause the oven to begin preheating. The display 101 may display: "preheating" or "preheating, please don't insert the pizza yet" during this time. When preheating is completed, the oven may issue an audible indication, indicating that the preheated is completed. At this time, the display may also indicate "preheat complete-insert pizza press any key". Another embodiment may automatically detect the pizza being inserted, e.g., by the infra red thermometer detecting the presence of the cold pizza.

The program indicated by the pizza box will not be started until the pizza has been inserted into the oven.

In addition, both the preheating completion time and the cooking completion time, or any other message about the cooking may be sent as a message over a network. For example, this may be sent as a text message shown generically as 151 to a user cell phone shown as 152, based on user information that has been previously stored or is automatically detected. The user may then get a text that says "oven is finished preheating" and/or "cooking is complete" or "10 minutes (estimated) until cooking is complete" or "please check the cooking, something may be wrong (which may be sent when some parameters become anomalous, e.g, temperature goes down or varies too much, gets too high, etc).

Similar operations can be carried out on other kinds of food. A loaf of bread may have a barcode, for example, that includes toasting instructions. The toaster can toasted based on these instructions.

Figure 3:
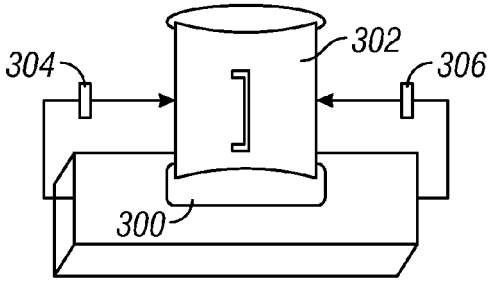
FIG. 3 shows an alternate embodiment for a warmer.

Another embodiment, shown in FIG. 3, may apply an analogous operation to a cup warmer or burner with a pan thereon, for example. A warmer part 300 receives a cuop 302 placed thereon. The warmer part also includes digital infrared thermometers which monitor a temperature of the cup. For example, the thermometers 304, 306 may monitor the cup temperature. When the cup temperature has reached a specified level, or stays at that level for a specified time, the reading may automatically be terminated. An advantage of this system is that the heating caused by an heater 300 may be reasonably aggressive in this way.

Another embodiment uses ads or marketing information in the barcode. When the cooking instructions are scanned, an icon or logo indicative of the company and/or the product may be displayed on the oven display screen. Information about the product, e.g, how to eat it, what to have with it, may be displayed. Coupons may be displayed and/or offered to the user.

The general structure and techniques, and more specific embodiments which can be used to effect different ways of carrying out the more general goals are described herein.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, while the above describes certain kinds of operation over the internet, any other way of interacting via a shared network can be similarly controlled in this way. Also, other cooking items can be similarly equipped. A burner on a stove can be controlled in a similar way, by locating a temperature sensor near the burner to sense the pan temperature. This may control by keeping the pan temperature at say 400° for 20 minutes, then stop. It may say keep at 400° for 10 minutes, signal the user to turn the food, then keep it at 400° for another 10 minutes.

Also, the inventors intend that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The computer may be an Intel (e.g., Pentium or Core 2 duo) or AMD based computer, running Windows XP or Linux, or may be a Macintosh computer. The computer may also be a laptop.

The programs may be written in C or Python, or Java, Brew or any other programming language. The programs may be resident on a storage medium, e.g., magnetic or optical, e.g. the computer hard drive, a removable disk or media such as a memory stick or SD media, wired or wireless network based or Bluetooth based Network Attached Storage (NAS), or other removable medium or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A cooking device, comprising:

a controllable heating part;

a controller for the controllable heating part;

a data reader, automatically reading cooking instructions and automatically establishing settings for said controllable heating part based on said automatically reading, wherein said cooking instructions include at least multiple items of information for said cooking, and wherein said controller uses each of said multiple items of information as part of cooking and of controlling said controllable heating part, and where at least one of said multiple items of information includes information indicative of detecting an actual amount of cooking that an object of cooking has received.

2. A device as in claim 1, wherein said reader is a barcode reader that reads a barcode which includes said settings.

3. A device as in claim 1, wherein said reader includes a wifi connection that reads said settings from a remote transmitter.

4. A device as in claim 2, further comprising a network connection, and wherein said barcode represents information that can be used to look up cooking information in a database accessible over said network connection.

5. A device as in claim 1, further comprising a contactless temperature sensing device which senses a temperature of at least one item being heated by said controllable heating part, wherein said controller uses said temperature as part of said controlling, and wherein said information indicative of detecting an actual amount of cooking that an object of cooking has received is information from said temperature sensing device.

6. A device as in claim 1, further comprising a contactless temperature sensing device which senses a temperature of at least one item being heated by said controllable heating part, wherein said controller uses a desired temperature of said object of cooking as part of said controlling, wherein said multiple items include at least a first value related to amount of heating by said cooking device and a second value related to a sensed temperature.

7. A cooking device, comprising:

a controllable heating part;

a controller for the controllable heating part;

a data reader, automatically reading cooking instructions and automatically establishing settings for said controllable heating part based on said automatically reading, further comprising a network connection, and wherein said controller automatically sends a message over said network connection to indicate that an operation has been completed.

8. A cooking device as in claim 7, wherein said controller automatically sends said message over said network connection to indicate that an oven preheating operation has been completed.

9. A cooking device, comprising:

a controllable heating part;

a controller for the controllable heating part, setting energization of said controllable heating part;

a contactless temperature sensing device which senses a temperature of at least one item being heated by said controllable heating part, wherein said controller uses said temperature as part of setting said energization, and a reader, automatically reading cooking instructions and automatically establishing settings for said controllable heating part based on said automatically reading, said reader automatically setting a desired temperature which must be sensed by said contactless temperature sensing device.

10. A device as in claim 9, wherein said reader is a barcode reader that reads a barcode which includes said settings.

11. A device as in claim 9, wherein said cooking instructions include at least multiple items of information for said cooking, and wherein said controller uses each of said multiple items of information as part of cooking and of controlling said controllable heating part.

12. A device as in claim 11, wherein said multiple items include at least a first value specifying a desired temperature of said item, and an amount of time to maintain said item at said temperature.

13. A device as in claim 9, further comprising a network connection, and wherein said controller automatically sends a message over said network connection to indicate that an operation specified by an operator has been completed.

14. A cooking device, comprising:

a controllable heating part;

a controller for the controllable heating part, controlling a program of energizing said controllable heating part according to a set program;

a network connection, coupled to receiving information from said controller, and sending a message over said network connection to a user indicating that at least one aspect of said program has been completed.

15. A cooking device as in claim 14, further comprising a contactless temperature sensing device which senses a temperature of at least one item being heated by said controllable heating part, wherein said controller uses said temperature as part of setting said energizing.

16. A cooking device as in claim 14, further comprising a reader, automatically reading cooking instructions and automatically establishing settings for said controllable heating part based on said automatically reading.

17. A cooking device as in claim 14, wherein said network connection sends a text message to a user.

18. A cooking device as in claim 14, wherein said network connection sends a message indicating that cooking is complete to a user.

19. A cooking device as in claim 14, wherein said network connection sends a message indicating that preheating is complete to a user.

* * * * *